US008555630B2

(12) United States Patent
Sato et al.

(10) Patent No.: US 8,555,630 B2
(45) Date of Patent: Oct. 15, 2013

(54) FLUID PRESSURE ACTUATOR UNIT

(75) Inventors: Osamu Sato, Minokamo (JP); Shiro Nishioka, Kani (JP)

(73) Assignee: Kayaba Industry Co., Ltd., Tokyo (JP)

( * ) Notice: Subject to any disclaimer, the term of this patent is extended or adjusted under 35 U.S.C. 154(b) by 616 days.

(21) Appl. No.: 12/923,816

(22) Filed: Oct. 8, 2010

(65) Prior Publication Data

US 2011/0088385 A1 Apr. 21, 2011

(30) Foreign Application Priority Data

Oct. 20, 2009 (JP) ..... 2009-241184

(51) Int. Cl.
*F15B 11/08* (2006.01)

(52) U.S. Cl.
USPC ..... 60/464; 60/477

(58) Field of Classification Search
USPC ..... 60/464, 477, 431, 468, 459; 91/441; 137/115.06, 115.21
See application file for complete search history.

(56) References Cited

FOREIGN PATENT DOCUMENTS

JP 2006-105226 A 4/2006

*Primary Examiner* — Edward Look
*Assistant Examiner* — Logan Kraft
(74) *Attorney, Agent, or Firm* — Rabin & Berdo, P.C.

(57) ABSTRACT

A fluid pressure cylinder (3) is connected to a discharge port (24) of a fluid pressure pump (2). A suction port (25) of the fluid pressure pump (2) is connected to a tank (10) via a suction passage (11) in which a flow restrictor (15) is provided. A change-over valve (4) changes over operation modes of the fluid pressure cylinder (3) between a load mode in which the pressure cylinder (3) is driven by the fluid pressure pump (2) and an unload mode in which the fluid pressure cylinder (3) elongates and contracts according to an external force exerted thereon in response to a differential pressure between the discharge port and the suction port. Automatic change-over of the operation modes of the pressure cylinder (3) in response to an operation of the fluid pressure pump (2) is thereby realized.

10 Claims, 6 Drawing Sheets

FLUID PRESSURE ACTUATOR UNIT

FIELD OF THE INVENTION

This invention relates to a fluid pressure actuator unit used, for example, for supporting a blade assembly of a lawn mower in an operation position and lifting the blade assembly to a lifted position as required.

BACKGROUND OF THE INVENTION

A lawn mower comprises, for example, a vehicle body, a blade assembly, and an actuator. The blade assembly is supported by the mower vehicle body via a floating mechanism so as to be able to rise and fall in an operating position in response to an external force exerted thereon. The actuator lifts the blade assembly from the operating position to a lifted position and keeps it in the lifted position. The actuator may be provided in the form of a fluid pressure actuator unit into which an electric motor, a fluid pressure pump, and a fluid pressure cylinder are integrated.

JP2006-105226A, published by the Japan Patent Office in 2006, proposes a fluid pressure actuator unit comprising an electric motor, a fluid pressure pump, a fluid pressure cylinder, and an operated check valve. The fluid pressure pump is a double-discharge type, driven by the electric motor, and discharges pressurized fluid to drive the fluid pressure cylinder to elongate or contract. The operated check valve operates in response to a discharge pressure of the fluid pressure pump so as to supply the discharged fluid to a corresponding fluid pressure chamber in the fluid pressure cylinder.

SUMMARY OF THE INVENTION

The fluid pressure actuator unit that lifts the blade assembly of the lawn mower to the lifted position is required to operate in two operation modes, i.e. a loaded mode in which the fluid pressure cylinder is driven to lift the blade assembly and an unloaded mode in which the blade assembly is free to rise and fall by leaving the fluid pressure cylinder free to elongate and contract. However, the operated check valve used in the prior art fluid pressure actuator unit is constructed to close when the discharge pressure of the fluid pressure pump is low. The unloaded mode is therefore not available in the prior art fluid pressure actuator unit.

It is therefore an object of this invention to provide a fluid pressure actuator unit that can operate selectively in the loaded mode or in the unloaded mode in response to an operation of the fluid pressure pump.

In order to achieve the above object, a fluid pressure actuator unit according to this invention comprises an electric motor, a fluid pressure pump comprising a discharge port and a suction port and driven by the electric motor to pressurize working fluid aspirated from the suction port and discharge the working fluid into the discharge port in a pressurized state, a fluid pressure cylinder that operates with the working fluid supplied from the discharge port, a tank that stores the working fluid, a suction passage that connects the suction port to the tank, a flow restrictor provided in the suction passage, and a change-over valve that connects the discharge port to the tank when a differential pressure between the discharge port and the suction port is not greater than a predetermined pressure and connects the suction port to the tank by bypassing the flow restrictor while disconnecting the discharge port from the tank when the differential pressure is greater the predetermined pressure.

The details as well as other features and advantages of this invention are set forth in the remainder of the specification and are shown in the accompanying drawings.

DESCRIPTION OF THE PREFERRED EMBODIMENTS

Figure 1:
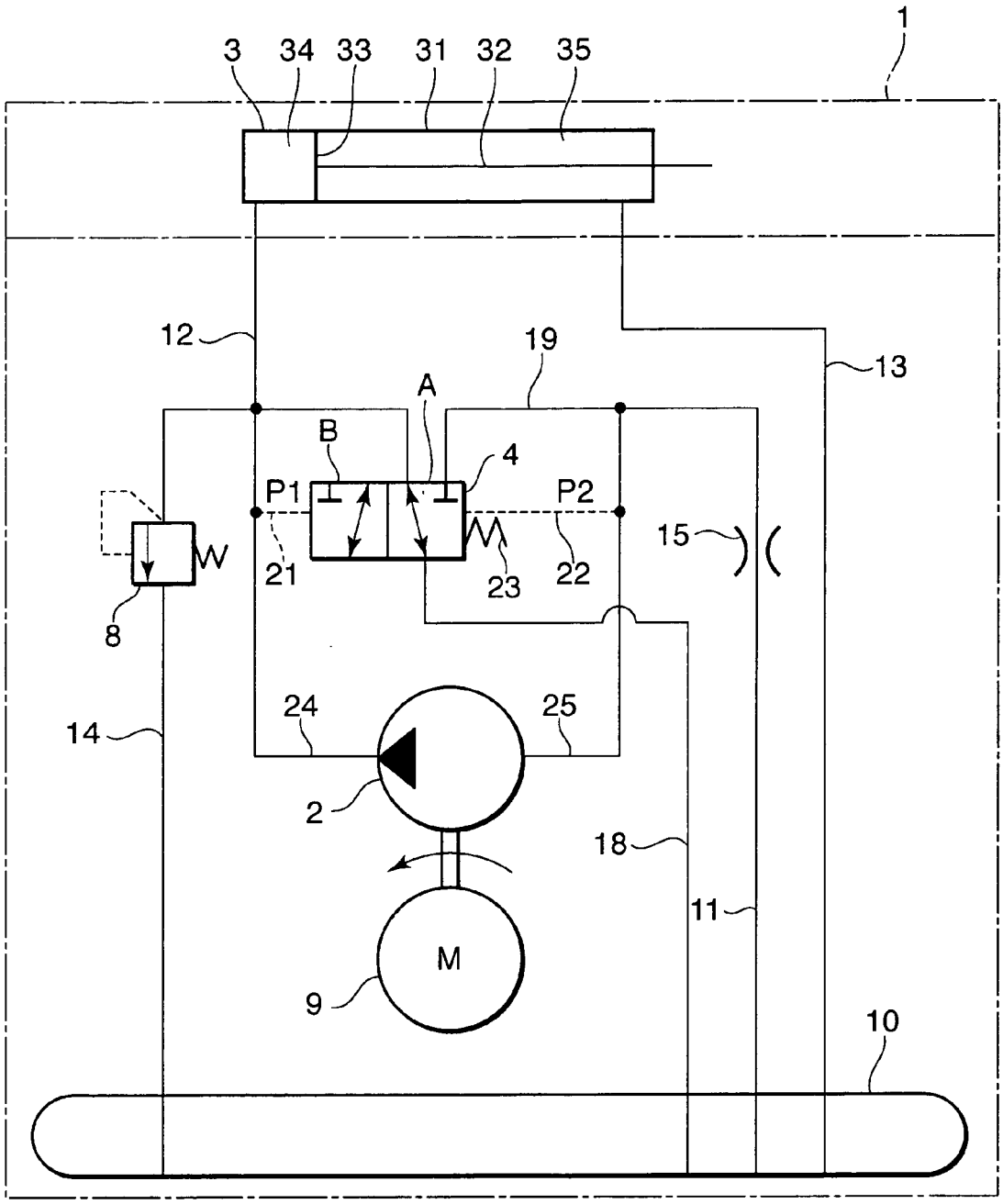
FIG. 1 is a fluid pressure circuit diagram of a fluid pressure actuator unit according to this invention.

Referring to FIG. 1 of the drawings, a fluid pressure actuator unit 1 for a lawn mower according to this invention comprises a fluid pressure pump 2 driven by an electric motor 9, a fluid pressure cylinder 3 driven to elongate by a working fluid discharged by the fluid pressure pump 2, and a tank 10 that stores the working fluid.

The fluid pressure pump 2 comprises a discharge port 24 and a suction port 25. In response to an operation of the electric motor 9, the fluid pressure pump 2 aspirates working fluid from the suction port 25 and discharges the working fluid into the discharge port 24 in a pressurized state.

The fluid pressure cylinder 3 comprises a cylinder tube 31, a piston 33 accommodated in the cylinder tube 31 so as to be free to slide in an axial direction, and a piston rod 32 that is connected to the piston 33 and projects outside from the cylinder tube 31 in the axial direction. The cylinder tube 31 is filled with oil as the working fluid. The oil may be substituted, for example, by a solution of a water soluble agent.

A bottom side pressure chamber 34 and a rod side pressure chamber 35 are formed by the piston 33 in the cylinder tube 31.

The bottom side pressure chamber 34 is connected to the discharge port 24 of the fluid pressure pump 2 via a discharge passage 12. The rod side pressure chamber 35 is connected to the tank 10 via a tank passage 13.

The suction port 25 of the fluid pressure pump 2 is connected to the tank 10 via suction passage 11.

A flow restrictor 15 constituted by an orifice, a choke, or the like is provided in the suction passage 11.

The discharge passage 12 is connected to the tank 10 via a relief passage 14. A relief valve 8 is provided in the relief passage 14. The relief valve 8 opens at a predetermined relief pressure to recirculate the working fluid from the discharge passage 12 to the tank 10, thereby preventing a pressure in the discharge passage 12 from becoming excessively high.

A blade assembly of a lawn mower is supported on a vehicle body of the lawn mower so as to be free to rise and fall via a floating mechanism. The fluid pressure cylinder 3 connects one of the cylinder tube 31 and the piston rod 32 to the vehicle body and connects the other of the cylinder tube 31 and the piston rod 32 to the blade assembly.

The fluid pressure cylinder 3 is driven to elongate by supplying the bottom side pressure chamber 34 with a discharged working fluid from the fluid pressure pump 2, thereby lifting the blade assembly from the operating position to a predetermined lifted position in the vehicle. On the other hand, the blade assembly in the operating position rises and falls arbitrarily with respect to the vehicle body according to an external force exerted thereon. In this state, the fluid pressure cylinder 3 elongates and contracts in synchronization with the rise and fall of the blade assembly so as not to prevent the blade assembly from rising and falling.

To enable the action of the fluid pressure actuator unit 1 as described above, the fluid pressure actuator unit 1 further comprises a change-over valve 4 that changes over between a loaded mode in which the fluid pressure cylinder 3 lifts the blade assembly and an unloaded mode in which the fluid pressure cylinder 3 allows the blade assembly to rise and fall according to the external force exerted thereon, in response to an operation of the fluid pressure pump 2. For this purpose, the change-over valve 4 comprises an unload position A corresponding to the unloaded mode and a load position B corresponding to the loaded mode.

The change-over valve 4 selectively connects a recirculation passage 18 leading to the tank 10 to the discharge passage 12 or a communication passage 19 that is connected to the suction passage 11 between the flow restrictor 15 and the suction port 25 of the fluid pressure pump 2. Specifically, in the unload position A, the change-over valve 4 connects the discharge passage 12 to the recirculation passage 18 while disconnecting the communication passage 19 from the recirculation passage 18. In the load position B, the change-over valve 4 connects the communication passage 19 to the recirculation passage 18 while disconnecting the discharge passage 12 from the recirculation passage 18.

The change-over valve 4 is biased towards the unload position A by a return spring 23. In contrast, a fluid pressure P1 in the discharge port 24 is exerted on the change-over valve 4 via a first pilot passage 21 in an opposite direction to a spring force of the return spring 23. Further, a fluid pressure P2 in the suction port 25 is exerted on the change-over valve 4 via a second pilot passage 22 in the same direction as the spring force of the return spring 23.

As long as a differential pressure between the fluid pressures P1 and P2 is not greater than the spring force of the return spring 23, the change-over valve 4 is kept in the unload position A. When the differential pressure between the fluid pressures P1 and P2 becomes greater than the spring force of the return spring 23, the discharge port 24 displaces from the unload position A to the load position B.

In a state where the fluid pressure pump 2 is not operative, since the differential pressure between the fluid pressures P1 and P2 is not greater than the spring force of the return spring 23, the change-over valve 4 keeps the unload position A. In this state, when an external compressive force is exerted on the piston rod 32, the bottom side pressure chamber 34 contracts and an amount of the working fluid corresponding to a contraction volume of the bottom side pressure chamber 34 flows out from the bottom side pressure chamber 34 to the tank 10 via the discharge passage 12, the change-over valve 4 in the unload position A, and the recirculation passage 18. Meanwhile, the expanding rod side pressure chamber 35 is provided with the working fluid from the tank 10 via the tank passage 13.

When an external elongation force is exerted on the piston rod 32 in a state where the fluid pressure pump 2 is not operative, the rod side pressure chamber 35 contracts and an amount of working fluid corresponding to a contraction volume of the rod side pressure chamber 35 flows out from the rod side pressure chamber 35 to the tank 10 via the tank passage 13. Meanwhile, the expanding bottom side pressure chamber 34 is provided with working fluid from the tank 10 via the recirculation passage 18, the change-over valve 4 in the unload position A, and the discharge passage 12.

As described above, the fluid pressure cylinder 3 elongates and contracts arbitrarily in response to an external force exerted thereon in the state where the fluid pressure pump 2 is not operative.

When the fluid pressure pump 2 is operative, or in other words driven by the electric motor 9, the fluid pressure pump 2 aspirates working fluid from the tank 10 via the suction passage 11, and pressurizes and discharge the aspirated working fluid into the discharge passage 12. Since the flow restrictor 15 is provided in the suction passage 11, the fluid pressure P2 in the suction port 25 of the fluid pressure pump 2 lowers as the fluid pressure pump 2 aspirates the working fluid due to a fluid pressure loss in the flow restrictor 15. On the other hand, the fluid pressure P1 in the discharge port 24 increases since the fluid pressure pump 2 discharges the pressurized working fluid into the discharge port 24.

As a result, the differential pressure between the fluid pressures P1 and P2 increases and when the differential pressure becomes greater than the spring force of the return spring 23, the change-over valve 4 changes over from the unload position A to the load position B. Thereafter, the discharged fluid from the fluid pressure pump 2 is provided exclusively to the bottom side pressure chamber 34 of the fluid pressure cylinder 3 via the discharge passage 12.

When the change-over valve 4 has changed over to the load position B, the recirculation passage 18 is connected to the suction passage 11 via the communication passage 19. Thereafter, the working fluid aspirated into the fluid pressure pump 2 is supplied from the tank 10 without passing through the flow restrictor 15 and instead passing through the recirculation passage 18, the change-over valve 4 in the load position B, the communication passage 19, and the suction passage 11. Thus, the flow restrictor 15 does not interrupt aspiration of the working fluid by the fluid pressure pump 2, and the fluid pressure pump 2 discharges a sufficient amount of the working fluid to drive the fluid pressure cylinder 3 at a preferred operation speed.

The fluid pressure cylinder 3 is driven to elongate by providing the bottom side pressure chamber 34 with the discharged working fluid from the fluid pressure pump 2 as described above, and the blade assembly is thereby lifted to the predetermined lifted position in the vehicle body.

As described above, the change-over valve 4 changes over from the unload position A to the load position B in response to the operation of the fluid pressure pump 2. Further, when the fluid pressure pump 2 stops operating, the differential pressure between the fluid pressures P1 and P2 becomes small such that the change-over valve 4 changes over from the load position B to the unload position A, thereby causing the fluid pressure cylinder 3 to elongate and contract arbitrarily again in response to an external load exerted thereon.

Figure 2:
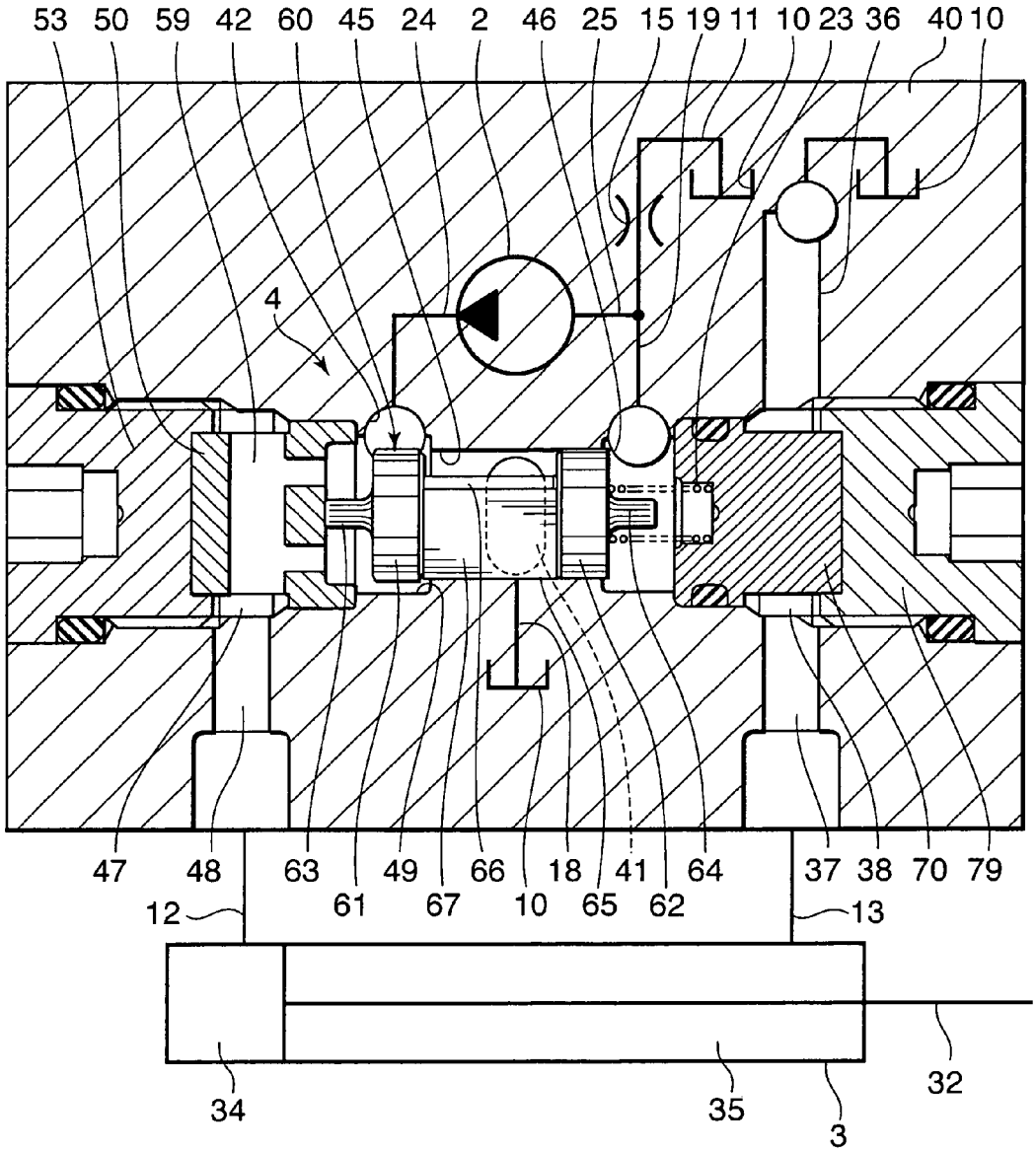
FIG. 2 is a longitudinal sectional view of a change-over valve according to this invention.

Referring to FIG. 2, the construction of the change-over valve 4 will be described.

The change-over valve 4 comprises a spool 60 that is accommodated in a spool hole 45 formed in a valve housing 40 so as to be free to slide in the spool hole 45 in an axial direction.

A tank port 41 opens onto a center portion of the spool hole 45 of the valve housing 40. The recirculation passage 18 is connected to the tank port 41.

A low-pressure port 46 opens onto the spool hole 45 on the right hand side of the spool 60 in the figure. The low-pressure port 46 is connected to the suction port 25 of the fluid pressure pump 2 permanently via the communication passage 19.

A high-pressure port 42 opens onto the spool hole 45 nearby a left end of the spool 60 in the figure. The high-pressure port 42 is connected to the discharge port 24 of the fluid pressure pump 2 permanently.

A stopper 50 is provided on the left end of the spool hole 45. The stopper 50 is supported by a plug 53 screwed into the valve housing 40. The spool 60 has a rod-shaped tip portion 63. The rod-shaped tip portion 63, when contacting the stopper 50, prevents the spool 60 from displacing further leftward in the figure. A flow path 59 is formed on the inside of the stopper 50. The flow path 59 connects the high-pressure port 42 to the bottom side pressure chamber 34 of the fluid pressure cylinder 3 permanently via an annular passage 47 and a bottom side port 48 formed in the valve housing 40. A fluid path formed between the high-pressure port 42 and the bottom side pressure chamber 34 via the flow path 59, the annular passage 47, and the bottom side port 48 constitutes the discharge passage 12.

A stopper 70 is provided on the right end of the spool hole 45. The stopper 70 is supported by a plug 79 screwed into the valve housing 40. The spool 60 has a rod-shaped base portion 64. The rod-shaped base portion 64, when contacting the stopper 70, prevents the spool 60 from displacing further rightward in the figure.

An annular passage 38 is formed on the outer circumferential surface of the stopper 70. The annular passage 38 connects a tank side port 36 and a rod side port 37 formed respectively in the valve housing 40. The tank side port 36 is connected to the tank 10 permanently and the rod side port 37 is connected to the rod side pressure chamber 35 of the fluid pressure cylinder 3 permanently. The tank side port 36, the annular passage 38, and the rod side port 37 constitute the tank passage 13.

Although the tank side port 36, the rod side port 37, and the annular passage 38 are formed in the valve housing 40 for convenience in this embodiment, they are not components of the change-over valve 4 but components of the tank passage 13 that is independent of the change-over valve 4.

The spool 60 comprises the rod-shaped tip portion 63, a first land portion 61, a guide portion 65, a second land portion 62, and the rod-shaped base portion 64.

Each of the first land portion 61 and the second land portion 62 is formed into a cylindrical shape such that an entire outer circumferential surface thereof slides on an inner circumferential surface of the spool hole 45. The rod-shaped tip portion 63 projects from a center of the first land portion 61 leftward along an axis of the spool hole 45. The rod-shaped base portion 64 projects form a center of the second land portion 62 rightward along the axis of the spool hole 45.

The guide portion 65 is located between the first land portion 61 and the second land portion 62, and has a substantially triangular cross-section. Each of the portions corresponding to the vertexes of the triangle is formed to have an arc-shaped cross section so as to slide on the inner circumferential surface of the spool hole 45, thereby serving as a guide surface 66. Two adjacent guide surfaces 66 are connected by a flat surface 67. To summarize, in the cross-section of the guide portion 65, each vertex of a regular triangle is formed into an arc shape.

The spool 60 causes the entire outer circumferential surface of the first land portion 61, the entire outer circumferential surface of the second land portion 62, and three guide surfaces 66 of the guide portion 65 to slide on the inner circumferential surface of the spool hole 45, thereby ensuring concentricity with the spool hole 45.

A coil-shaped return spring 23 passing on the outside of the rod-shaped base portion 64 is interposed between the second land portion 62 and the stopper 70.

In the figure, the spool 60 supported by a resilient force of the return spring 23 makes the rod-shaped tip portion 63 contact the stopper 50. This position of the spool 60 corresponds to the unload position A, in which the high-pressure port 42 is connected to the tank port 41 and the low-pressure port 46 is disconnected from the tank port 41.

The spool 60 in the unload position A keeps the first land portion 61 on the outside of the spool hole 45 axially so as to form a gap between the inner circumferential surface 49 of the valve housing 40 on the outside of the spool hole 45 and the first land portion 61. The discharge port 24 is connected to the recirculation passage 18 via this gap and a gap formed between the inner circumferential surface of the spool hole 45 and the flat surfaces 67 of the guide portion 65.

Figure 3:
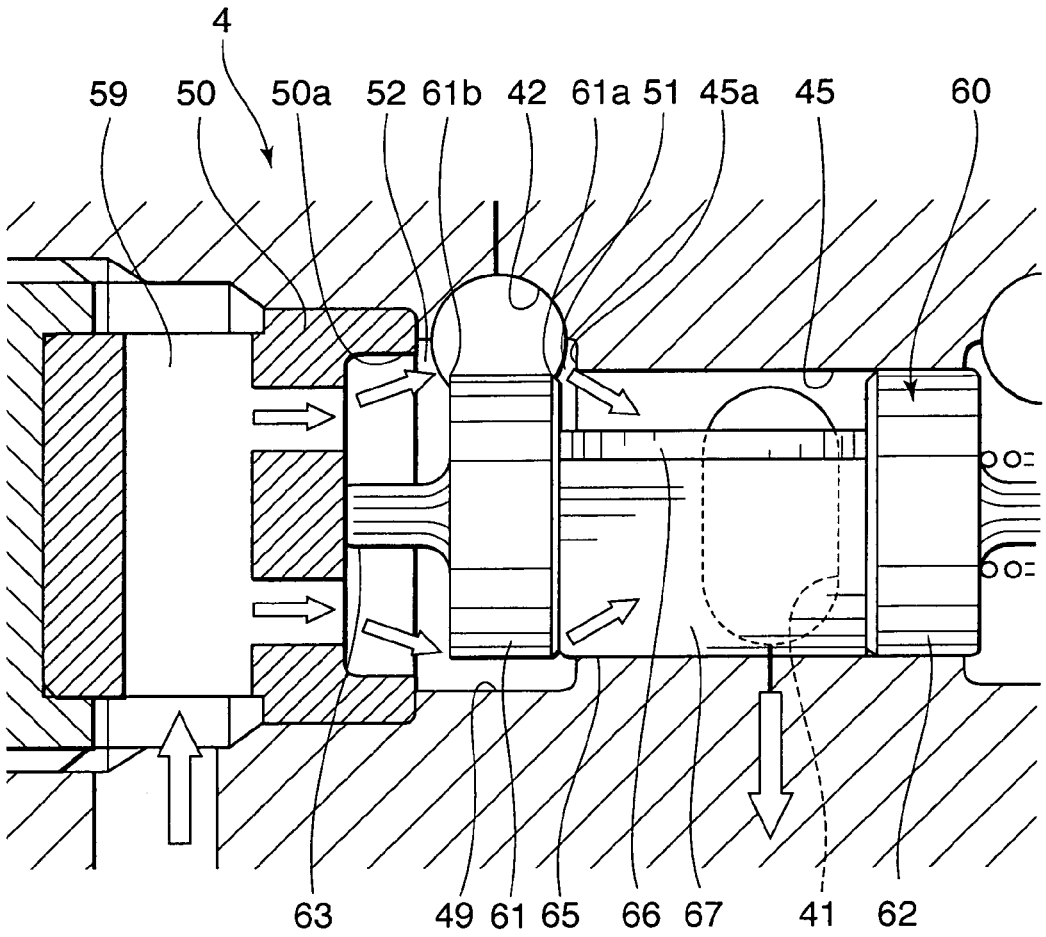
FIG. 3 is an enlarged longitudinal sectional view of essential parts of the change-over valve.

Referring to FIG. 3, in the unload position A of the spool 60 where the rod-shaped tip portion 63 contacts the stopper 50, a fluid flow from the bottom side pressure chamber 34 of the fluid pressure cylinder 3 to the tank port 41 is formed through a second annular passage 52 that is formed between a tip edge 61*b* of the first land portion 61 and an annular edge 50*a* of the stopper 50 and a first annular passage 51 formed between a base edge 61*a* of the first land portion 61 and an edge 45*a* of the spool hole 45.

According to this embodiment, a cross-sectional area A2 of the second annular passage 52 is set to be greater than a cross-sectional area A1 of the first annular passage 51 when the spool 60 is in the unload position A.

Referring to FIGS. 1 and 2, when the fluid pressure pump 2 starts to operate, the fluid pressure P1 in the discharge port 24 increases and the fluid pressure P2 in the suction port 25 decreases. When the differential pressure there-between becomes greater than the spring force of the return spring 23, the change-over valve 4 moves the spool 60 from the unload position A in a right-hand direction in FIG. 2 while compressing the return spring 23 until the rod-shaped base portion 64 contacts the stopper 70.

Figure 9:
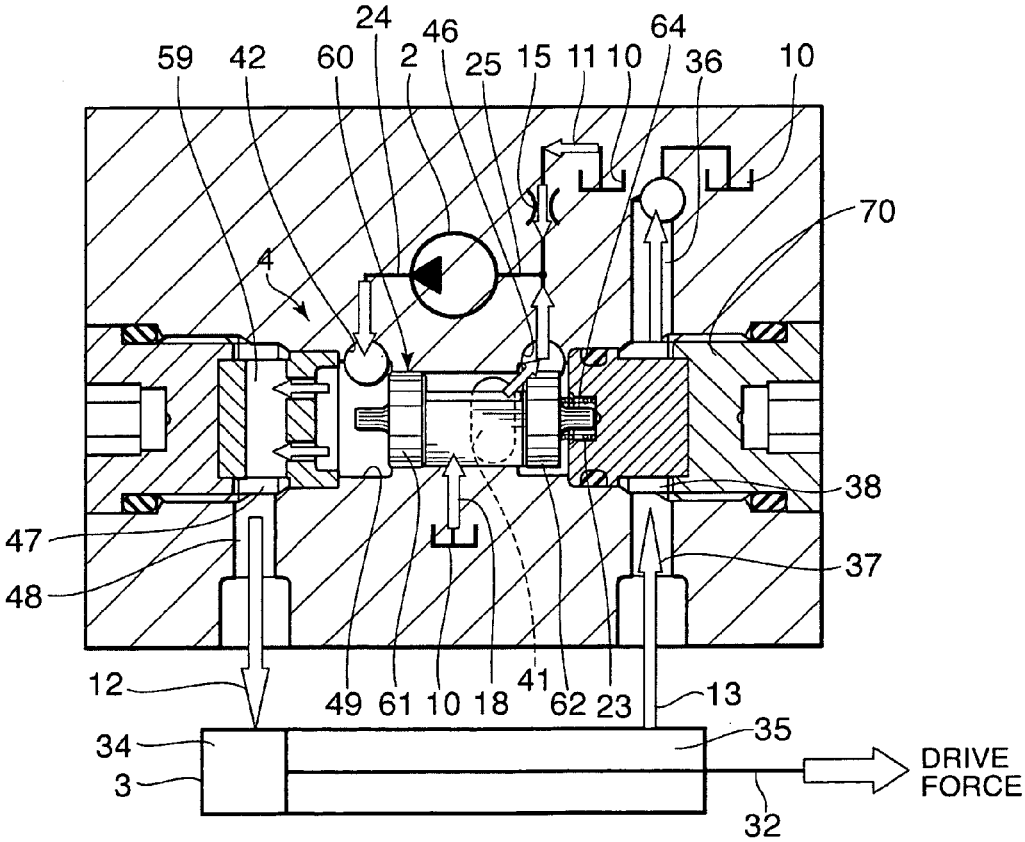
FIG. 9 is a longitudinal sectional view of the change-over valve in a load position, showing the working fluid flow when the fluid pressure cylinder is driven to elongate.

Referring to FIG. 9, the position of the spool 60 in which the rod-shaped base portion 64 of the spool 60 contacts the stopper 70 corresponds to the load position B. In the load position B, the high-pressure port 42 is disconnected from the tank port 41 and the low-pressure port 46 is connected to the tank port 41.

In the load position B, the first land portion 61 is in the spool hole 45 such that the discharge port 24 is disconnected from the recirculation passage 18. On the other hand, the second land portion 62 is on the outside of the spool hole 45 axially such that the low-pressure port 46 is connected to the tank port 41. In the load position B, therefore, the communication passage 19 is connected to the recirculation passage 18.

Next, an operation of the fluid pressure actuator unit 1 will be described.

Referring again to FIGS. 4 and 5, a working fluid flow formed in the fluid pressure actuator unit 1 in the unloaded mode when the fluid pressure cylinder 3 contracts due to an external compressive force Fc in a non-operative state of the fluid pressure pump 2 will be described.

Figure 4:
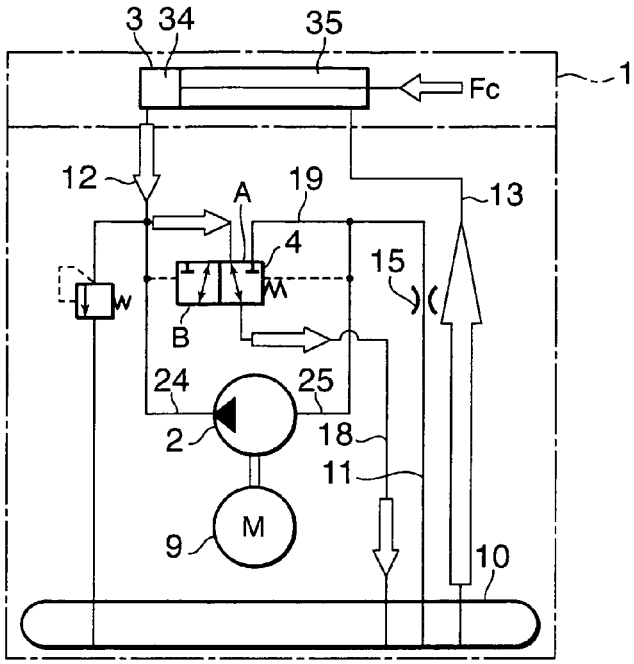
FIG. 4 is a fluid pressure circuit diagram of the fluid pressure actuator unit in an unloaded mode, showing a working fluid flow when a fluid pressure cylinder contracts.

Referring to FIG. 4, the spool 60 is kept in the unload position A by the spring force of the return spring 23 since the fluid pressure pump 2 is not operative in the unloaded mode.

In this state, when the external compressive force Fc is exerted on the fluid pressure cylinder 3, the fluid pressure cylinder 3 contracts and the working fluid in the bottom side pressure chamber 34 flows out to the tank 10 via the discharge passage 12, the change-over valve 4, and the recirculation passage 18 as shown by arrows in the figure. Simultaneously, the working fluid in the tank 10 is supplied to the rod side pressure chamber 35 via the tank passage 13.

Figure 5:
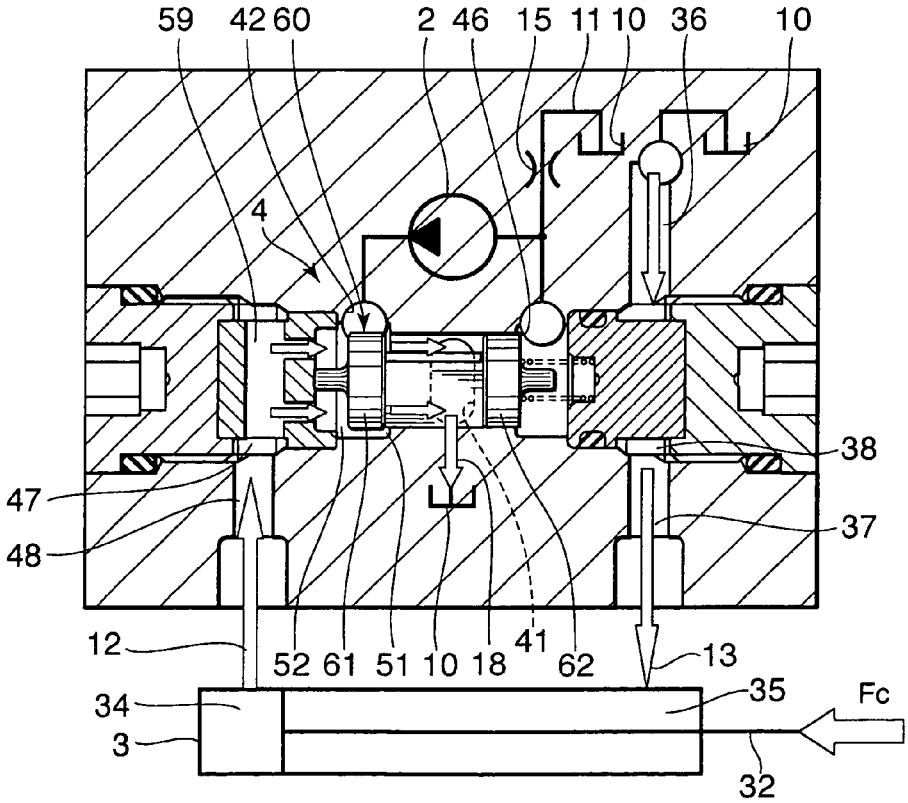
FIG. 5 is a longitudinal sectional view of the change-over valve in an unload position, showing the working fluid flow when the fluid pressure cylinder contracts.

Referring to FIG. 5, the change-over valve 4 causes the working fluid to flow from the discharge passage 12 to the recirculation passage 18 via the bottom side port 48, the annular passage 47, the flow path 59 in the stopper 50, the second annular passage 52, the first annular passage 51, and the tank port 41, as shown by arrows in the figure The first annular passage 51 and the second annular passage 52 bring about a fluid pressure loss in this working fluid flow in accordance with a flow rate of the working fluid. As a result, a force corresponding to this fluid pressure loss acts on the spool 60 in a right hand direction in the figure against the spring force of the return spring 23. To prevent the spool 60 from moving from the unload position A due to the force corresponding to the fluid pressure loss in the annular passages 51, 52, the initial spring load of the return spring 23 is previously set in the following manner.

Specifically, considering a predetermined allowable contraction speed of the fluid pressure cylinder 3, an allowable flow rate of the change-over valve 4 with respect to a fluid flow from the discharge passage 12 to the recirculation passage 18 is calculated. A fluid pressure loss in the first annular passage 51 and the second annular passage 52 when the allowable flow rate of the working fluid is achieved is then calculated. Finally, the spring load of the return spring 23 is set such that a spring force of the return spring 23 is greater than the force corresponding to the fluid pressure loss.

Figure 6:
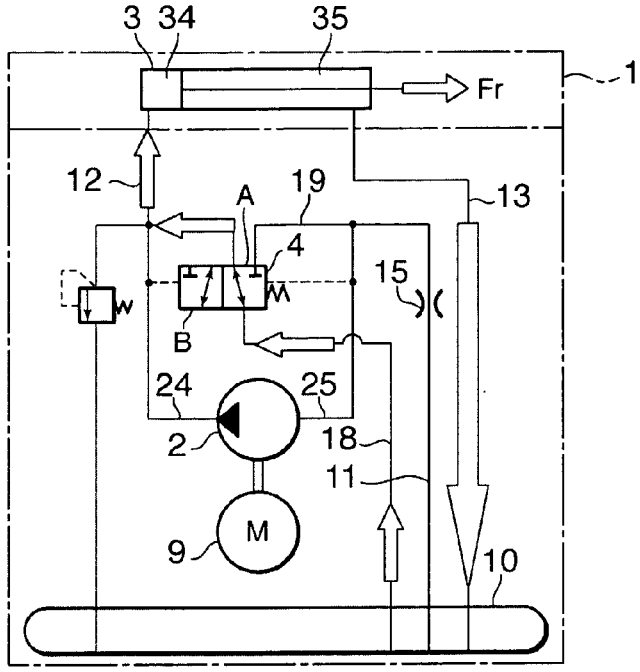
FIG. 6 is a fluid pressure circuit diagram of the fluid pressure actuator unit in the unloaded mode, showing the working fluid flow when the fluid pressure cylinder elongates.
Figure 7:
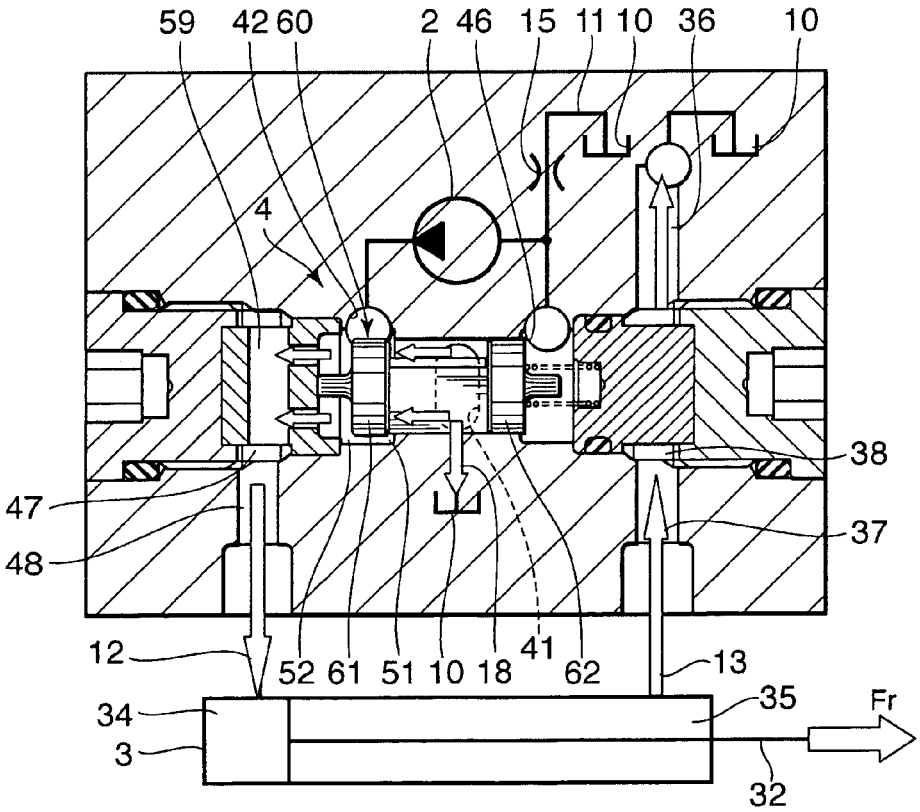
FIG. 7 is a longitudinal sectional view of the change-over valve in the unload position, showing the working fluid flow when the fluid pressure cylinder elongates.

Referring to FIGS. 6 and 7, a working fluid flow formed in the fluid pressure actuator unit 1 in the unloaded mode when the fluid pressure cylinder 3 elongates due to an external elongation force Fr will be described.

Referring to FIG. 6, the spool 60 is kept in the unload position A by the spring force of the return spring 23 since the fluid pressure pump 2 is not operative.

In this state, when the external elongation force Fr is exerted on the fluid pressure cylinder 3, the fluid pressure cylinder 3 elongates and the working fluid in the tank 10 flows into the bottom side pressure chamber 34 via the recirculation passage 18, the change-over valve 4, and the discharge passage 12 as shown by arrows in the figure. Simultaneously, the working fluid in the rod side pressure chamber 35 flows out to the tank 10 via the tank passage 13.

Referring to FIG. 7, the change-over valve 4 causes the working fluid to flow from the recirculation passage 18 to the discharge passage 12 via the tank port 41, the first annular passage 51, the second annular passage 52, the flow path 59 in the stopper 50, the annular passage 47, and the bottom side port 48, as shown by arrows in the figure As described above, in the unloaded mode, in which the fluid pressure pump 2 is not operative, the fluid pressure cylinder 3 elongates and contracts arbitrarily in accordance with the rise and fall of the blade assembly.

Next, a working fluid flow formed in the fluid pressure actuator unit 1 in the loaded mode, in which the fluid pressure cylinder 3 is driven to elongate by the operation of the fluid pressure pump 2, will be described.

When the fluid pressure pump 2 starts to operate, the spool 60 is located in the unload position A as shown in FIGS. 5 and 7. In this state, when the fluid pressure pump 2 operates, the working fluid in the tank 10 flows into the suction port 25 of the fluid pressure pump 2 via the suction passage 11. The working oil aspirated from the suction port 25 is pressurized in the fluid pressure pump 2, and then discharged into the discharge port 24.

A part of the pressurized working fluid in the discharge port 24 is supplied to the bottom side pressure chamber 34 directly via the discharge passage 12. The rest of the pressurized working fluid in the discharge port 24 flows out to the recirculation passage 18 via the first annular passage 5, the gap formed between the flat surfaces 67 of the guide portion 65 and the inner circumferential surface of the spool hole 45, and the tank port 41.

Assuming that a fluid pressure in the high-pressure port 42 is P1 and a fluid pressure loss in the second annular passage 52 is PA2, a fluid pressure corresponding to P1-PA2 acts on the spool 60 in the right-hand direction of the figures.

On the other hand, when the fluid pressure pump 2 operates, a fluid pressure P2 in the suction port 25 and in the low pressure port 46 decreases due to the fluid pressure loss in the flow restrictor 15 provided in the suction passage 11.

As the fluid pressure in the low-pressure port 46 decreases, a differential pressure between the pressure P1-PA2 acting on the spool in the left hand direction and the fluid pressure P2 acting on the spool 60 in the right hand direction increases. When the differential pressure becomes greater than the spring force of the return spring 23, the spool 60 displaces in the right-hand direction of the figures.

Referring to FIG. 9, when the rod-shaped base portion 64 contacts the stopper 70, the spool 60 reaches the load position B, and further sliding in the right-hand direction is thereby prevented.

In this change-over valve 4, as described above, when the spool 60 is in the unload position A, the cross-sectional area A2 of the second annular passage 52 is set to be greater than the cross-sectional area A1 of the first annular passage 51. When the fluid pressure pump 2 starts to operate in the unload position A of the spool 60, the fluid pressure loss PA2 in the second annular passage 52 is therefore smaller than the fluid pressure loss PA1 in the first annular passage 51. As the fluid pressure loss PA2 becomes smaller, the differential pressure between the pressure P1-PA2 acting on the spool 60 and the fluid pressure P2 acting on the spool 60 increases. Making the cross-sectional area A2 of the second annular passage 52 greater than the cross-sectional area A1 of the first annular passage 51 therefore leads to a reduction in a required time for the spool 60 to reach the load position B from the point at which the fluid pressure pump 2 starts to operate, thereby improving the response of the change-over valve 4.

When the change-over valve 4 is displaced to the load position B, the flow path formed between the high-pressure port 42 and the recirculation passage 18 via the tank port 41 is closed.

Figure 8:
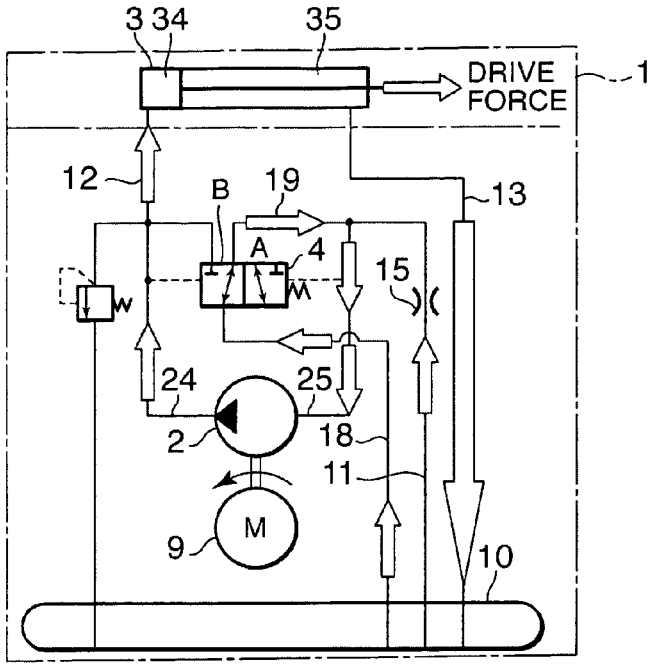
FIG. 8 is a fluid pressure circuit diagram of the fluid pressure actuator unit in a loaded mode, showing the working fluid flow when the fluid pressure cylinder is driven to elongate.

Referring to FIG. 8, when the change-over valve 4 is in the load position B, the entire amount of the working fluid discharged from the fluid pressure pump 2 is supplied to the bottom side pressure chamber 34 via the discharge passage 12. The fluid pressure cylinder 3 causes the piston rod 32 to elongate, thereby lifting the blade assembly from the operating position to the lifted position in the vehicle body. In response to elongation of the piston rod 32, the working fluid in the rod side pressure chamber 35 flows out to the tank 10 via the tank passage 13.

According to this fluid pressure actuator unit 1, before the change-over valve 4 displaces to the load position B, the fluid pressure P2 in the suction port 25 of the fluid pressure pump 2 decreases due to the fluid pressure loss in the flow restrictor 15, but once the spool 60 reaches the load position B, the working fluid in the tank 10 is supplied to the suction port 25 via the recirculation passage 18, the tank port 41, and the low-pressure port 46 without passing through the flow restrictor 15. Accordingly, the working fluid is suctioned by the fluid pressure pump 2 without undergoing pressure loss due to the flow restrictor 15. The electric motor 9 that drives the fluid pressure pump 2 therefore does not suffer from an excessive load.

The blade assembly thus lifted to the lifted position is kept in the lifted position using a lock device. Once the lock device is activated, operation of the fluid pressure pump 2 is stopped. The blade assembly thus kept in the lifted position can be lowered to the operating position by simply releasing the lock device. By releasing the lock device in a state where the fluid pressure pump 2 is inoperative, the fluid pressure actuator unit 1 comes into a state shown in FIGS. 4 and 5, and a self weight of the blade assembly, which acts as the external compressive force Fc, causes the fluid pressure cylinder 3 to contract such that the blade assembly falls to the operating position.

As described above, according to this fluid pressure actuator unit 1, in the unloaded mode, in which the fluid pressure pump 2 is not operative, the change-over valve 4 connects the bottom side pressure chamber 34 of the fluid pressure cylinder 3 to the tank 10 such that the fluid pressure cylinder 3 elongates and contracts arbitrarily in response to the external compressive force Fc and the external elongation force Fr. Accordingly, the blade assembly supported in the operating position by the fluid pressure cylinder 3 can rise and fall arbitrarily in response to an undulation in the ground surface, for example.

When the fluid pressure pump 2 starts to operate, the change-over valve 4 changes over to the load position in response to the differential pressure between the discharge pressure and the suction pressure of the fluid pressure pump 2, and supplies the working fluid discharged by the fluid pressure pump 2 to the bottom side pressure chamber 34 of the fluid pressure cylinder 3. As a result, the fluid pressure cylinder 3 is driven to elongate, whereby the blade assembly supported by the fluid pressure cylinder 3 is lifted promptly from the operating position to the lifted position.

The change-over valve 4 does not require a manual change-over operation by an operator of the lawn mower since it operates in response to the operation of the fluid pressure pump 2. Hence, the lifting operation of the blade assembly is made easy according to this fluid pressure actuator unit 1.

The contents of Tokugan2009-241184, with a filing date of Oct. 20, 2009 in Japan, are hereby incorporated by reference.

Although the invention has been described above with reference to certain embodiments, the invention is not limited to the embodiments described above. Modifications and variations of the embodiments described above will occur to those skilled in the art, within the scope of the claims.

For example, in the embodiment described above, the blade assembly is lifted to the lifted position by driving the fluid pressure cylinder 3 to elongate by supplying the working fluid discharged from the fluid pressure pump 2 to the bottom side pressure chamber 34. It is also possible to lift the blade assembly to the lifted position by driving the fluid pressure cylinder 3 to contract by supplying the working fluid discharged from the fluid pressure pump 2 to the rod side pressure chamber 35. In this case, the bottom side pressure chamber 34 is connected to the tank 10 via the tank passage 13 and the rod side pressure chamber 35 is supplied with the working fluid discharged from the fluid pressure pump 2 via the discharge passage 12. The change-over valve 4 connects the recirculation passage 18 selectively to the discharge passage 12 or the communication passage 19 as in the case of the embodiment described above.

In the embodiment described above, the fluid pressure cylinder 3 is constituted by a piston cylinder having the piston 33. The fluid pressure cylinder 3 may be constituted by a ram cylinder that does not have the piston 33. The ram cylinder has a single fluid pressure chamber in the cylinder tube and does not have a rod side pressure chamber 35. By applying a ram cylinder to the fluid pressure cylinder 3, the tank passage 13 can be omitted. However, in terms of ensuring a pressure receiving area with respect to the working fluid discharged by the fluid pressure pump 2, a piston cylinder is generally preferred to a ram cylinder.

In the embodiment described above, the fluid pressure actuator unit 1 is applied to a lawn mower, but the fluid pressure actuator unit 1 according to this invention can be applied to various machines and devices other than a lawn mower.

The embodiments of this invention in which an exclusive property or privilege is claimed are defined as follows:

What is claimed is:

1. A fluid pressure actuator unit comprising:

an electric motor;

a fluid pressure pump comprising a discharge port and a suction port, which is driven by the electric motor to pressurize working fluid aspirated from the suction port and discharge the working fluid into the discharge port in a pressurized state;

a fluid pressure cylinder that is operated by the working fluid supplied from the discharge port;

a tank that stores the working fluid;

a suction passage that connects the suction port to the tank;

a flow restrictor provided in the suction passage; and a change-over valve that connects the discharge port to the tank when a differential pressure between the discharge port and the suction port is not greater than a predetermined pressure, and connects the suction port to the tank by bypassing the flow restrictor while disconnecting the discharge port from the tank when the differential pressure is greater the predetermined pressure.

2. The fluid pressure actuator unit as defined in claim 1, wherein the change-over valve comprises an unload position in which the discharge port is connected to the tank to cause the fluid pressure cylinder to elongate and contract arbitrarily according to an external force exerted thereon and a load position in which the discharge port is disconnected from the tank, wherein the unload position and the load position are changed over in response to the differential pressure.

3. The fluid pressure actuator unit as defined in claim 2, wherein the fluid pressure cylinder comprises a cylinder tube, a piston accommodated in the cylinder tube, a piston rod connected to the piston and projecting outside from the cylinder tube, an inner space of the cylinder tube being separated by the piston into a bottom side pressure chamber connected to the tank and a rod side pressure chamber connected to the discharge port.

4. The fluid pressure actuator unit as defined in claim 3, further comprising a discharge passage connected to the bottom side pressure chamber, wherein:

the change-over valve comprises a spool hole, a spool accommodated in the spool hole so as to be free to slide, a discharge pressure of the discharge port and a suction pressure of the suction port acting on the spool in opposite directions with respect to a spool sliding direction, and a return spring that supports the spool against the discharge pressure, the unload position and the load position are represented by a sliding position of the spool, and the change-over valve further comprises a first annular passage through which the spool in the unload position connects the discharge port to the tank and a second annular passage through which the spool in the unload position connects the discharge passage to the discharge port, the first annular passage being closed by the spool in the load position.

5. The fluid pressure actuator unit as defined in claim 4, wherein a flow cross-sectional area of the second annular passage is set to be greater than a flow cross-sectional area of the first annular passage in a state where the spool is in the unload position.

6. The fluid pressure actuator unit as defined in claim 4, wherein the spool comprises a first land portion that increases the flow cross-sectional area of the second annular passage and decreases the flow cross-sectional area of the first annular passage in response to an increase in the differential pressure.

7. The fluid pressure actuator unit as defined in claim 6, wherein the spool further comprises a second land portion that connects the suction port to the tank in the load position and disconnects the suction port from the tank in the unload position.

8. The fluid pressure actuator unit as defined in claim 7, wherein the change-over valve further comprises a tank port that opens onto the spool hole between the first land portion and the second land portion, connects the suction port to the tank when the spool is in the load position, and connects the first annular passage to the tank when the spool is in the unload position.

9. The fluid pressure actuator unit as defined in claim 1, wherein the fluid pressure cylinder is a cylinder that causes a blade assembly of a lawn mower to rise and fall.

10. The fluid pressure actuator unit as defined in claim 9, wherein the fluid pressure cylinder is driven in a direction for elongating using the working fluid supplied from the discharge port.

* * * * *